US007159432B2

(12) United States Patent
Schüle

(10) Patent No.: US 7,159,432 B2
(45) Date of Patent: Jan. 9, 2007

(54) DEVICE FOR BENDING PROFILES BY THINNING A WALL OF THE PROFILE

(76) Inventor: Peter Schüle, Bösinger Str. 5, D-72285 Pfalzgrafenweiler (DE)

( * ) Notice: Subject to any disclaimer, the term of this patent is extended or adjusted under 35 U.S.C. 154(b) by 0 days.

(21) Appl. No.: 10/478,557

(22) PCT Filed: May 18, 2002

(86) PCT No.: PCT/EP02/05523

§ 371 (c)(1),
(2), (4) Date: Jun. 21, 2004

(87) PCT Pub. No.: WO02/094469

PCT Pub. Date: Nov. 28, 2002

(65) Prior Publication Data

US 2004/0244453 A1 Dec. 9, 2004

(30) Foreign Application Priority Data

May 21, 2001 (DE) ..... 101 24 801

(51) Int. Cl.
*B21D 11/08* (2006.01)

(52) U.S. Cl. ..... 72/167; 72/78

(58) Field of Classification Search ..... 72/167, 72/78, 136

See application file for complete search history.

(56) References Cited

U.S. PATENT DOCUMENTS

| | | | | |
|---|---|---|---|---|
| 1,158,294 A | * | 10/1915 | Robinson | 72/124 |
| 2,047,084 A | * | 7/1936 | Smith | 72/167 |
| 2,901,930 A | | 9/1959 | Wilman | |
| 3,339,392 A | * | 9/1967 | Buckwalter et al. | 72/166 |

FOREIGN PATENT DOCUMENTS

| | | | | |
|---|---|---|---|---|
| DE | 689018 | | 12/1936 | |
| DE | 719986 | | 4/1939 | |
| DE | 1806592 | | 8/1969 | |
| DE | 2461538 | | 7/1975 | |
| DE | 2903929 | | 8/1980 | |
| DE | 212 199 | * | 8/1984 | 72/167 |

(Continued)

*Primary Examiner*—Daniel C. Crane
(74) *Attorney, Agent, or Firm*—Friedrich Kueffner

(57) ABSTRACT

In a device and in a process for bending a tube 72, the tube 72 is guided through a bending tool 71, which rotates around a section guide housing 81, 82 and also around a cam unit formed by two tubes 83, 84. Rollers 86 serve as pressing elements, and a mandrel 73 serves as an abutment; as the tube 72 is pushed through the section guide housing 81, 82 between the rollers 86 and the mandrel 73, it is squeezed to different degrees in different areas of its wall cross section, so that, as a result of the stretching and squeezing of the tube 72, a bend is produced. The size of the bending radius of the tube 72 to be bent is determined by the eccentricity adjusted via the cam unit and/or by the axial feed of the rollers 86 toward the section guide housing 81, 82. By means of the bending tool 71 according to the invention, it is possible to produce different bending radii in one and the same bending device in a tube 72 to be bent by changing the feed, that is, the distance between the rollers 86 and the mandrel 73. No uncontrolled cracks or deformations occur. The bending tool 71 used imposes only minimal limitations on how the tube 72 can be bent in any of 3 dimensions, which means that a section can be bent into any desired shape.

12 Claims, 10 Drawing Sheets

FOREIGN PATENT DOCUMENTS

| | | | | | |
|---|---|---|---|---|---|
| DE | 3523025 | | 1/1987 | | |
| DE | 3823675 | | 12/1992 | | |
| DE | 197 33 932 | A1 | 2/1999 | | |
| DE | 297 16 272 | U1 | 3/1999 | | |
| EP | 0928646 | | 7/1999 | | |
| JP | 60-115331 | * | 6/1985 | ..... | 72/167 |

* cited by examiner

DEVICE FOR BENDING PROFILES BY THINNING A WALL OF THE PROFILE

This application is a 371 of PCT/EP02/05523, filed May 18, 2002.

The invention pertains to a device and to a process for bending sections which have a section wall with cross-sectional areas at different distances from the axis of the bend to be produced, comprising a bending tool with at least one pressing element assigned to the outside surface of the section wall, the bending tool also having at least one opposing pressing element assigned to at least one of the pressing elements, and where at least one pressing element and at least one opposing pressing element assigned to one of the pressing elements can be moved relative to each other to squeeze at least one cross-sectional area of the section wall in the cross-sectional direction, this cross-sectional area being on the outside with respect to the axis of the bend.

A bending device of this type is also described in DE 689 018.

Various devices are known which can be used to bend sections; in these devices, a force greater than the yield point of the material is introduced into the workpiece. This force has the effect of stretching part of the outside surface of the workpiece and of compressing part of the inside surface, thus producing a bend. Certain limits are imposed on this bending process by the shape-holding strength of the material, because, when the shape-holding strength is exceeded, the material can crack, become indented, or buckle. At the same time, the number of degrees of freedom is limited. Machines which apply this process especially to tubing are known as mandrel bending machines, bending presses, and multi-roll bending machines. The radii of the bends which can be produced by mandrel bending machines and bending presses are predetermined by the shapes of the tools. Multi-roll machines make it possible to produce different radii, which follow each other in helical fashion, but only relatively large ratios between the radius and the diameter of the tubing (5–10) are possible.

In the case of roll-stretch bending or round bending, the former-dependent shape is produced by the rotation of a center roll, while bending moment is exerted simultaneously by pressing the section against the center roll. In the case of roll-stretch bending, an additional axial tensile stress is superimposed on the other stresses.

A bending machine is known from DE 689 018, in which a tool cooperating with an impact-producing object (e.g., an air hammer) is used to produce curves by striking sectioned rails. Two or more movable hammers are assigned to an anvil; the hammers are controlled by the impact-producing device. As a result of their shape and the distance between them and the anvil, which is itself designed in a manner corresponding to the e of the rail, the hammers act on the two adjoining sidepieces of the rail section in such a way that the rail is stretched in a way so as to obtain the desired curvature.

The present invention is based on the task of creating a bending device and a bending process which do not need to exert any axial tensile stresses during the bending of sections and which allow bends of any desired shape to be produced.

This task is accomplished with respect to the device in that the pressing element or elements are advanced toward the opposing pressing element or elements in the cross-sectional direction while maintaining a gap between them, the width of the gap in at least one cross-sectional area being smaller than a cross-sectional area of the wall of the section to be bent which is being transported through the gap.

The device according to the invention thus offers the advantage that sections with different radii of curvature can be produced in one and the same bending device. An opposing pressing element such as a cheek, a roller, a roll, or a mandrel, which is designed to conform to the section to be bent, is held in place against the inside walls of the section to be bent and is positioned in such a way that it opposes a pressing element, which can be moved toward the opposing pressing element to within any selected distance. The approach of the two elements toward each other can also be accomplished by advancing the opposing pressing element toward the pressing element in such a way that a gap always remains between the pressing element and the opposing pressing element, through which the section to be bent is transported. As it is being transported through the gap, the section or a part of the section is squeezed powerfully enough to produce the desired bend. As a result of this squeezing effect, the sectioned wall becomes thinner where it was squeezed, either at just one point or possibly over a certain longitudinal extent of the section. On the part of the section opposite the squeezed part, the section can be compressed. During a bending operation, the section to be bent can also be rotated, so that the direction in which the section is bent can also be influenced.

According to the invention, the section provided for bending is squeezed to varying degrees by the exertion of radially oriented forces on various cross-sectional areas of the section wall, so that the bending is caused by the stretching and squeezing of the material of the section. The force can be applied by a ram, by a roll, or by a roller acting against an opposing pressing element resting against the section, and the material of the section can be squeezed to a predetermined extent between the ram, the roll, or the roller and the opposing pressing element to various degrees around the circumference or contour of the section. During a bending process, the section to be bent can, as needed, be pushed either in stages or continuously in the axial direction of the section through the bending device according to the invention, that is, intermittently in shorter or longer steps or continuously at uniform or at varying speed.

According to the process implemented in accordance with the invention, the wall forming the outside dimension of the section is squeezed between two tools, portion by portion, by the advance of the workpiece (section) to be bent. Thus the stretching required to produce the bend is produced by the squeezing of the wall on one side of the workpiece. The material is squeezed in the radial direction, which thus causes a stretching in the axial direction. The section is thus bent. On the opposite side of, for example, the wall of tube, it is also possible for squeezing in the axial direction of the section to occur. In this process, the degree of bending can be adjusted quite accurately by varying the amount of force exerted; in comparison with the state of the art, no blows need to be struck, and the danger of overstretching is avoided. The pressing elements and the opposing pressing elements are set as close to each other as desired, and the desired bend can be obtained by adjusting the cross section of the gap to the desired width. During a bending operation, the pressing element or elements and the opposing pressing element or elements can be moved in the radial direction in such a way that the size of the gap and/or the shape of the gap changes. As a result, the surface of the material will also have a better appearance, and no additional tools such as wrinkle smoothers are required to obtain a surface of acceptable appearance. Any desired bend can be produced by rotating the section to be bent and then by squeezing it. It is also easy to influence the bending, that is, the degree of bending or the bending direction, by adjusting the feed and thus the length of the individual sections. The feed can be either intermittent or continuous. Sections with high-quality surfaces are obtained when the force is introduced transversely by way of an upper and/or a lower roll. So that the section can be given any desired shape, various bends can be achieved by varying, according to a preferred embodiment, the amount of force introduced by way of the roll surface. By squeezing only one side of the section, such as the top, only one edge part of the material is squeezed, and thus the change in length occurs only in this area, which makes it possible to obtain a section with the desired curvature.

A mandrel is inserted into the section to be bent, such as a length of tubing, and the material is then squeezed between the mandrel and a ram. The ram is designed here so that it conforms to the external shape of the section to be bent and is thus able to transmit the force effectively. In the case of a continuous bend, the force can also be introduced by a roller or by a ram, which exerts a varying amount of force. The opposing pressing element is a mandrel, which is inserted into the interior of the section and rests at least partially against the inside surface of the section; this mandrel absorbs the pressure of the movable ram or roller.

A similarly designed device, by means of which the process can be implemented, has a die for guiding the material to be bent, where a tool (pressing element), which introduces the force, such as a ram, is able to move laterally along the die toward the workpiece. The die also has an abutment for the ram at the bottom end. A mandrel, which can be inserted into the workpiece, is also provided, against which the ram can be moved (predetermined setting), so that the workpiece material is squeezed between the mandrel and the ram, which causes the material to stretch out in the axial direction.

A device for bending sections has at least one roller or roll instead of a ram as a force-exerting tool. The amount of force exerted along the surface of the roll can be varied.

In various preferred embodiments of the bending device according to the invention, the minimum of one pressing element is designed as a movable ram or as movable rams and/or as a movable roll or as movable rollers, and the opposing pressing element is designed as a mandrel, which is installed opposite the ram or rams or opposite the roller or rollers, and which can be positioned to rest against at least part of the inside circumferential surface of the hollow section.

According to the invention, the size and/or the cross-sectional shape of the gap is adjustable. By advancing the one or more pressing elements toward the one or more opposing pressing elements, gaps of any desired shape and size can be obtained, in which the sections of the section walls being transported through the gap can be squeezed in any desired way. Bending radii can be produced over a wide range, and a wide variety of bending shapes can be obtained.

The section to be bent can be pushed and/or pulled through the gap. This has the advantage that, depending on the size of the section, on the thickness of the material of the section to be bent, and/or on the contour of the section, it is possible to select from among a wide variety of transport modes to guide the section to be bent between the pressing elements and the opposing pressing elements. It is obvious that the bending tool (pressing and opposing pressing elements) can also be moved with respect to the section to be bent, i.e., moved in the axial direction, in order to bend the selected section in the desired way.

The pressing elements can be designed as rams, as rollers, and/or as rolls, whereas the opposing pressing elements can be in the form of mandrels, support cheeks, anvil configurations, rollers, rolls, etc. The opposing pressing elements rest against the interior areas of the cross section of the section wall to be bent, and it is obvious that the external contours of the pressing elements and of the opposing pressing elements will be adapted to conform to the shape of the section to be bent.

As a further elaboration of the bending device according to the invention, one or more rollers are rotatably supported so that they are parallel to the axial course of the section to be bent or so that the axis of rotation of the rollers is transverse to the axial orientation of the section to be bent.

The pressure exerted on the ram or rams or on the one or more rollers can be varied in the direction transverse to the axial orientation of the section to be bent. Varying the pressure setting in this way makes it possible to bend the section to be bent in different directions.

In addition, the direction in which a section is bent can be influenced by using holding means such as a chuck to hold the section during the bending operation, so that the section can either be kept stationary in the bending direction, shifted axially, and/or rotated around the axis of the section.

In a preferred embodiment of the bending device according to the invention, the bending device has a stationary section guide housing. A cam unit is mounted so that it can rotate around the section guide housing, and the pressing element or elements are mounted on the cam unit so that they can rotate independently of it.

The orientation of the pressing element or elements with respect to the section guide housing can be adjusted independently of the cam unit. The cam unit can be formed by a first and a second circular tube, one of which, when seen in cross section, surrounds the other. The two tubes can be rotated relative to each other. In one embodiment, the circular tubes can be locked in place in any rotational position.

In another embodiment of the bending device according to the invention, the orientations of the pressing element or elements with respect to the section guide housing can be adjusted by means of one or more wedge rods or by one or more conical sleeves.

When the pressing elements are mounted so that they can rotate around the section guide housing, the material can be squeezed relatively uniformly around the entire circumference of the section.

It is also advantageous for the cam unit to be adjustable either by a hydraulic system or by means of a gear assembly.

With respect to the process according to the invention for bending sections, the task is accomplished by bending the sections by exerting force on both sides, in the cross-sectional direction, of a cross-sectional area of the wall of the section situated on the outside with respect to the axis of the bend, as a result of which this area is squeezed and thus stretched out in the longitudinal direction of the section; and by not exerting any force in the cross-sectional direction on a cross-sectional area of the wall of the section situated on the inside relative to the axis of the bend or by exerting force on both sides of this inside area to squeeze it and thus to stretch it out in the longitudinal direction of the section but to a lesser degree than the cross-sectional wall area on the outside. These are the process steps that are used to bend sections with walls with cross-sectional areas that are at different distances from the axis of the bend. At least one section of the wall of the section or sections to be bent is transported through a gap, which brings about the squeezing.

In additional embodiments of the process, one or more cross-sectional areas of the section wall are acted upon and squeezed by one or more movable rams or by one or more rotating rollers, which are moved via a cam unit and/or via feed devices to positions at a greater or lesser distance away from the longitudinal axis of the hollow section to be bent.

The device according to the invention and the process according to the invention make it possible to bend sections of any desired cross-sectional shape, including sections which are closed all the way around the circumference, such as circular tubing, into shapes which can have almost any radius of curvature and which can proceed in almost any direction, with a high degree of dimensional accuracy and reproducibility. Cracks and uncontrolled deformations of the sections to be bent are avoided. The bending tools impose only minimal limitations on the three-dimensional possibilities for bending a section, which means that any desired shape can be produced by the action of one and the same bending device on the section to be bent.

In addition, the previously mentioned features and those presented below can be used either individually or in any desired combination with each other. The previously mentioned embodiments are not to be understood as a final list; rather, they are to be understood merely as examples.

The individual figures of the drawing show both the functional principles and an embodiment of the bending device according to the invention in highly schematic form. The individual features shown in the drawings are not to scale. The features of the bending device according to the invention are presented in such a way that their inventive design can be easily appreciated:

Figure 19A:
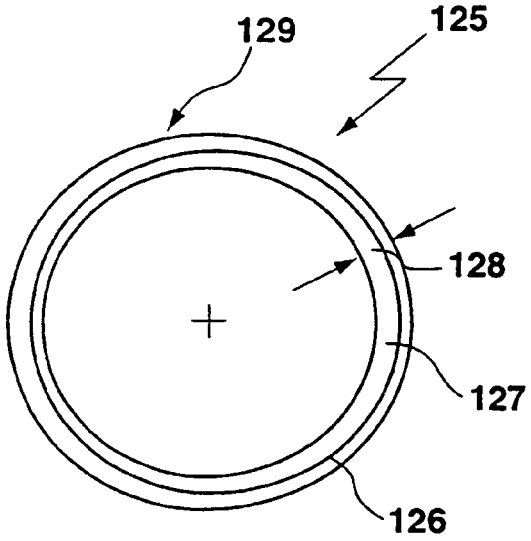
Figure 19B:
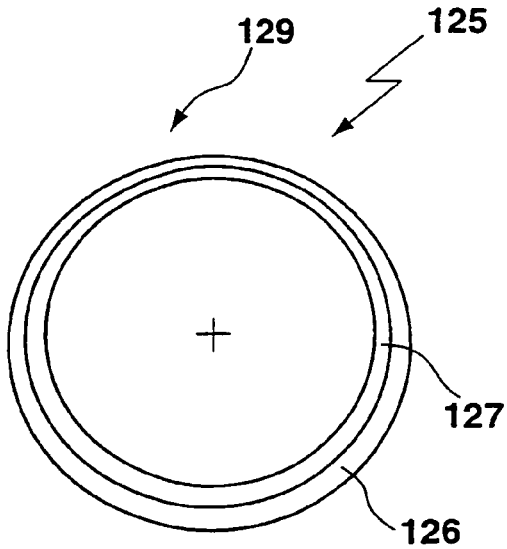

FIG. 19*a* shows a schematic diagram of a cam unit of a bending device according to the invention in the neutral position; and FIG. 19*b* shows a schematic diagram of a cam unit of a bending device according to the invention in which the maximum degree of eccentricity is being used.

Figure 1:
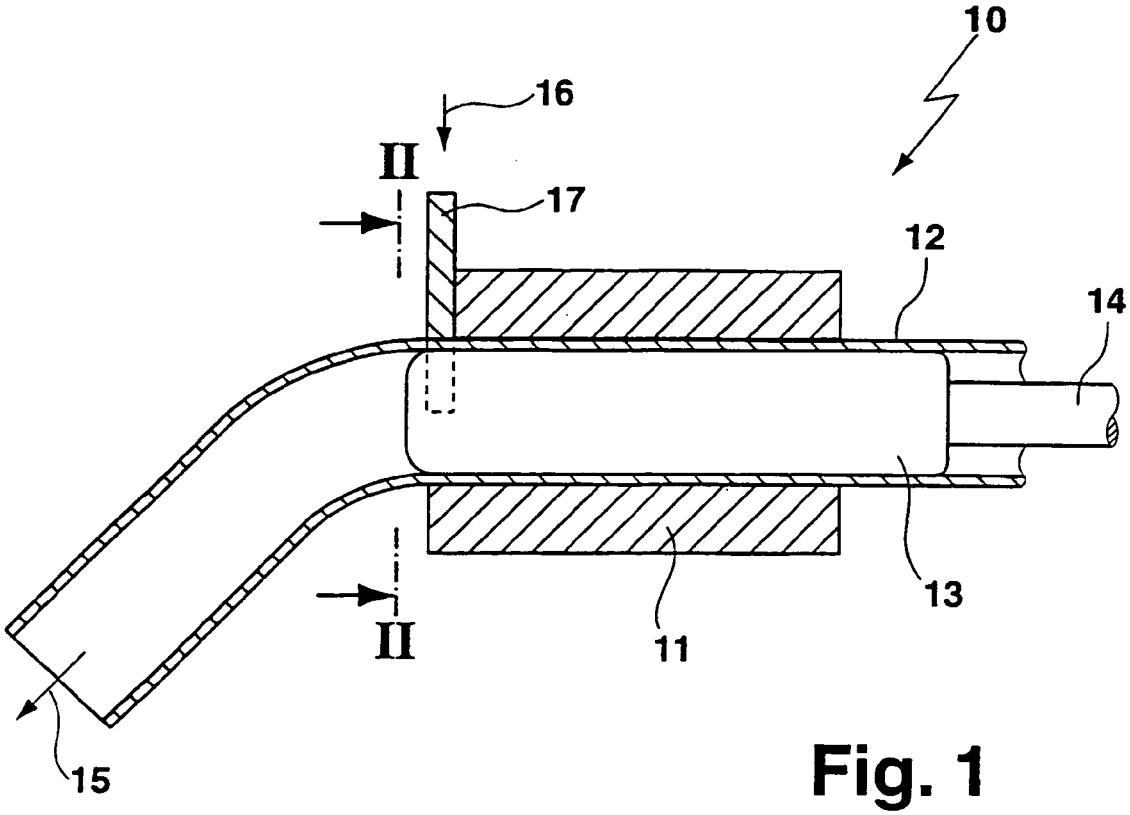
FIG. 1 shows a longitudinal cross section of the bending principle of a bending device according to the invention.

FIG. 1 shows a bending principle 10 for a bending device according to the invention with a die 11, through which a circular tube 12 can be pushed. The die 11 holds the tube 12 and maintains it in its proper orientation. The die 11 is stationary. In the tube, a mandrel 13 is inserted, which rests against the inside circumference of the tube 12; the diameter of the mandrel is as large as the inside diameter of the tube 12. The mandrel 13 is permanently connected to a mandrel rod 14, by which the mandrel 13 is positioned and held immovably in the tube 12 during the bending process. The tube 12 can be pushed in the direction of the arrow 15 through the die 11 and over the mandrel 13. A ram 17, which is free to move in the direction of the arrow 16, is mounted at the end of the die 11, so that, when the ram exerts pressure on the tube 12, it will also be pressing against the mandrel 13, which forms an abutment to cooperate with the ram 17. In the embodiment according to FIG. 1, the ram 17 extends around half of the circumference of the tube. The ram 17 can be pushed with such force against the external circumferential surface of the tube that the tube 12 is squeezed in the area of the ram 17 and thus stretched out. As a result, a bend is produced in the tube 12. It is obvious that the tube 12 can be squeezed by several movable rams mounted around the circumference of the tube 12. If the tube 12 does not have a circular cross section, movable rams which cover different areas of the outside circumference of the tube can be used, and the cross-sectional form of the mandrel will also always be designed to conform to the inside circumference of the tube to be bent, so that the mandrel can serve as an effective abutment for the movable rams.

The tube in FIG. 1, into the interior of which an axially movable mandrel 13 has been inserted, is subjected to a squeezing force acting in the radial direction; the squeezing between the movable ram 17 and the mandrel 13 leads to a stretching in the axial direction of the tube wall. The die 11 serves as a guide and as an abutment underneath the ram 17 to absorb the force applied by the ram 17. By means of the axial, stepwise feed of the tube 12, the tube 12 can be bent into the desired form. If desired, it is also possible to use a wrinkle smoother here. The desired degree of bending is obtained by adjusting the amount of force exerted.

Figure 2:
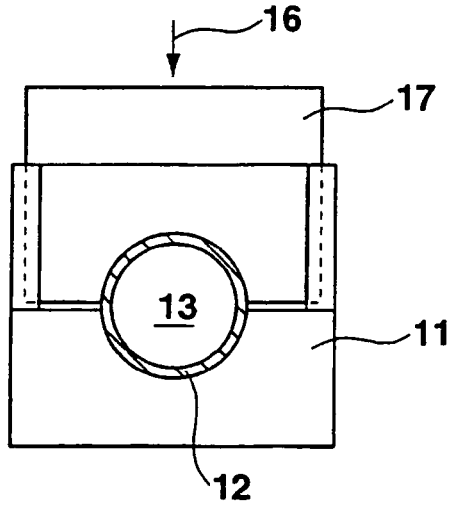
FIG. 2 shows a cross section along line II—II of FIG. 1.

FIG. 2 shows the arrangement of the bending principle 10 of FIG. 1 in a view along line II—II. The tube 12 is held stably in the die 11, and the mandrel, which completely fills the free inside diameter of the tube, maintains the diametric shape of the tube 12 even when the ram 17 is pressed in the directions of arrow 16 with such force against the outside circumference of the tube 12 that the tube 12 is squeezed in the area of contact between the ram 17 and the outside circumference of the tube. The ram 17 surrounds essentially only half of the circumference of the tube 12, and across this area the ram produces a squeezing effect in the radial direction and a stretching of the tube 12 in the axial direction. The circumferential surface of the tube 12 to be bent situated opposite the ram 12 rests in the die 11.

Figure 3:
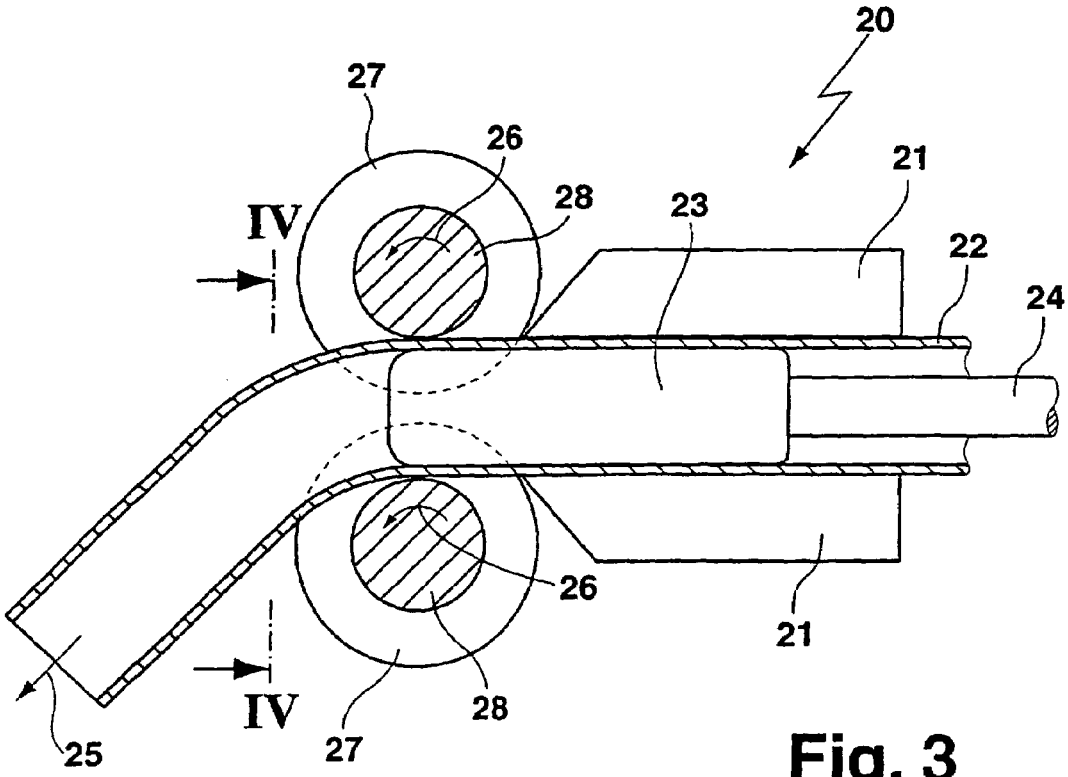
FIG. 3 shows a longitudinal cross section of the principle of a bending device according to the invention with pressing elements in the form of rollers.

FIG. 3 shows another embodiment of a bending principle 20 according to the invention. A die 21 guides a circular tube to be bent in such a way that its axis remains stable even when force is exerted on the tube. A mandrel 23, which is kept stationary by a mandrel rod 24, is inserted into the tube 22 and ensures that, even when force is being exerted on the outside circumference of the tube 22, the original diameter or shape of the tube will not be changed.

The circular tube 22 can be pushed continuously in the direction of arrow 25 through the die 21 so that tube 22 will be bent. Rollers 27, which conform to the external contour of the tube 22, rotate in the direction of arrow 26 on the outside circumference of the tube 22. The pressures which the rollers 27 exert on the outside circumference of the tube 22 can be varied over their surfaces 28, and therefore the circular tube 22 can be bent as it is being squeezed.

Figure 4:
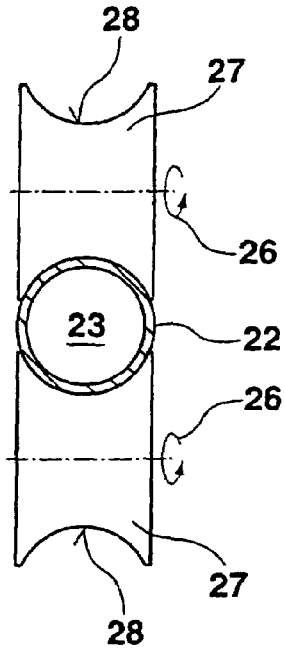
FIG. 4 shows a cross section along line IV—IV of FIG. 3.

FIG. 4 shows the bending principle according to FIG. 3 in a view along line IV—IV. The shape of the tube 22 is maintained by the mandrel 23, and the rollers 27 exert different forces via their roller surfaces 28 on the outside circumference of the tube 22, so that the tube 22 can be bent in the desired manner. The rollers 27 can be advanced toward each other to different degrees and can rotate in the direction of the arrows 26 in whatever orientation they have assumed. In FIG. 4, the axis of rotation of the rollers 27 is shown in broken line. It is also possible for the axis of rotation of the rollers 27 to be tilted out of the position shown in the figure, so that the force exerted by the roller on the hollow section to squeeze it can be varied across the surface of the roller.

Figure 5:
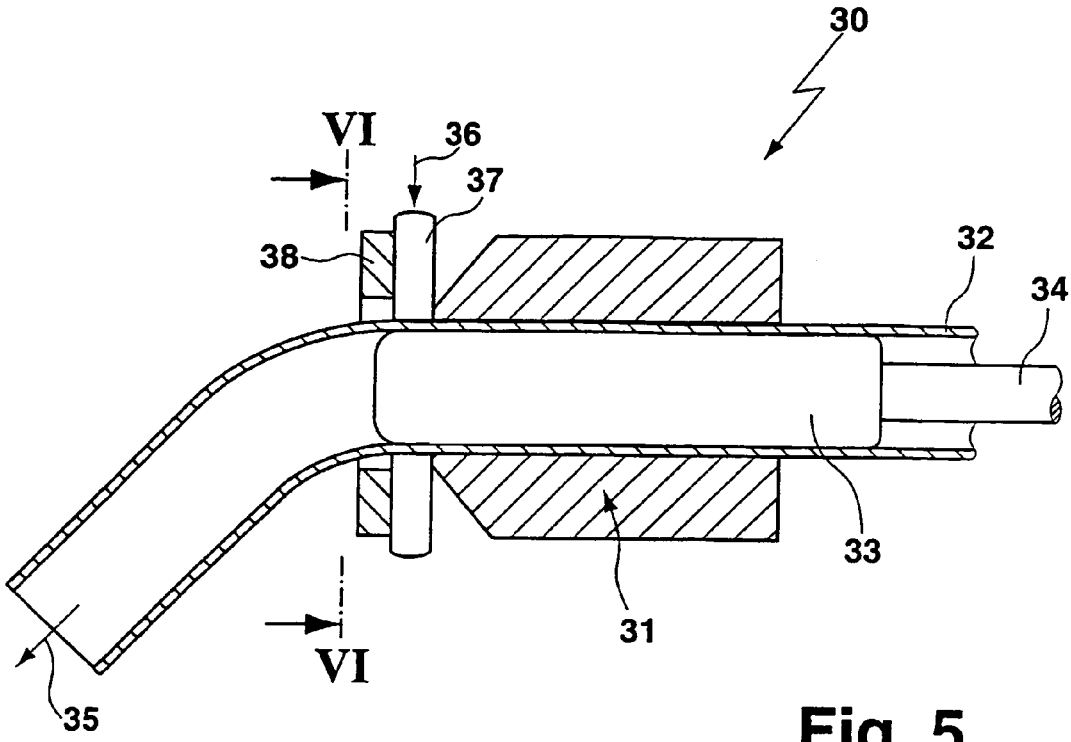
FIG. 5 shows a longitudinal cross section of a bending principle according to the invention with rollers as the pressing elements and with a mandrel as the opposing pressing element.

FIG. 5 shows a bending principle 30 according to the invention with a stationary die 31 and a tube 32 with a round cross section, which is guided through the die 31. A mandrel 33 is inserted into the tube 32; the mandrel is pushed by a mandrel rod 34 into a position suitable for the bending of the tube 32. The tube 32 to be bent passes through the die 31 in the direction of the arrow 35, and the rollers 37, which serve as pressing elements, are advanced in the direction of the arrow 36 toward the outside wall of the tube in such a way that, as the tube 32 is pushed through the die 31 while the mandrel 33 is being held in position, the outside circumferential surface of the tube 32 is squeezed. The rollers 37 are mounted on a roller holder 38, which can rotate around the tube 32 to be bent.

Figure 6:
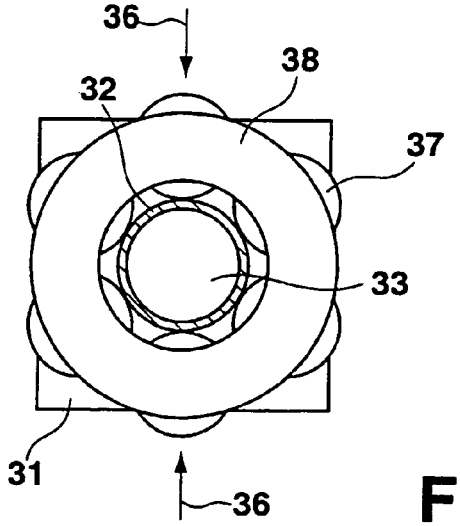
FIG. 6 shows a view along line VI—VI of FIG. 5.

FIG. 6 shows a view along line VI—VI of FIG. 5; in the drawing, the rollers 37 are covered by the roller holder 38. In the interior of the tube 32, the mandrel 33 is arranged in such a way that it fills up the entire hollow space inside the tube 32 and can thus form an effective abutment and opposing pressing element for the pressing elements, which, in the present case, are the rollers 37. The rollers 37 are advanced toward the mandrel 33 in the direction of the arrow 36 until there is only a small gap between the mandrel 33 and the rollers 37, which gap produces the desired squeezing and thus the desired bending when the tube 32 is pushed through the gap.

Figure 7:
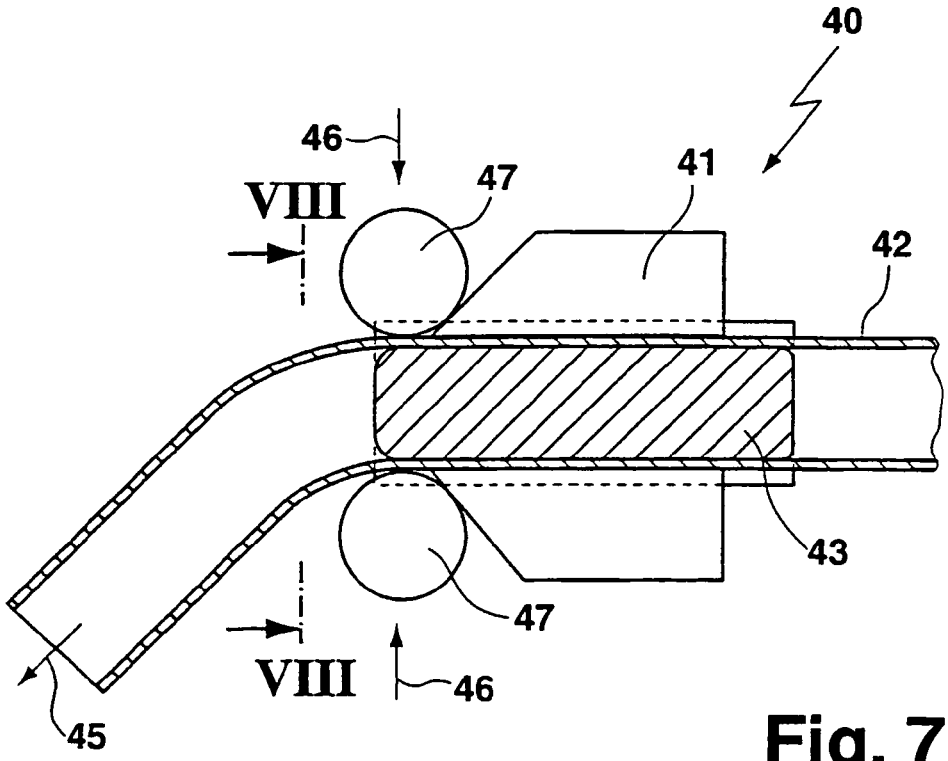
FIG. 7 shows a side view of a bending principle according to the invention with an H-shaped section for bending.

FIG. 7 shows a side view of another bending principle 40 according to the invention. An H-shaped section 42 is guided with freedom of movement through a die 41, and cheeks 43 are brought up from both sides to rest against the lateral inside walls and the web of the H-shaped section 42 to be bent; according to the invention, these cheeks form the opposing pressing elements. The H-section 42 to be bent is conducted through the die 41 in the direction of the arrow 45, and as the rollers 47 are advanced in the direction of arrow 46, the outside surfaces of the H-section 42 to be bent are squeezed. To produce the squeezing shown in the figure, the upper roller 47 is advanced closer to the cheeks 43 than the lower roller 47. No change in the feed setting is made during the bending operation.

Figure 8:
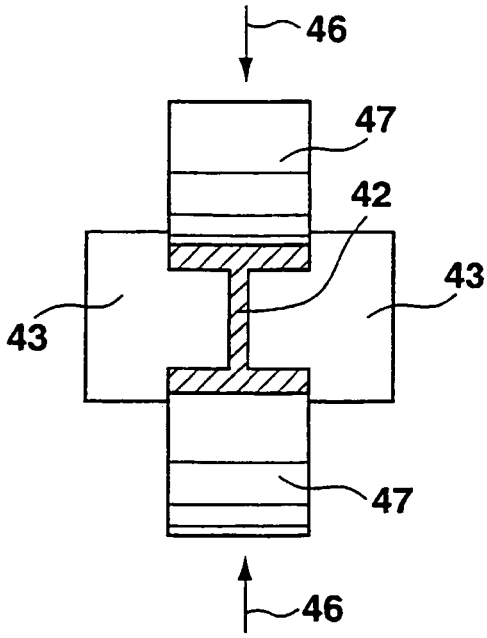
FIG. 8 shows a view along line VIII—VIII of FIG. 7.

FIG. 8 shows a view along line VIII—VIII of FIG. 7. The direction in which the H-section 42 to be bent proceeds through the bending device is outward from the plane of the drawing. The cheeks 43 stabilize the H-section 42 to be bent on both sides, and the bending of the H-section 42 is produced by the rollers 47, which can be also be designed as rolls. The arrows 46 indicate the forward feed of the rollers 47 toward the cheeks 43.

FIGS. 7 and 8 show the bending principle on the basis of an H-shaped section 42, where an upper roller 47 serves as the force-introducing tool and the lower roller 47 as the abutment and/or also as a force-exerting tool. The H-section 42 is guided by the cheeks 43, which also form abutments for the rollers 47. As can be seen more clearly in FIG. 8, cheeks 43 are provided on the sides of the H-section 42. The material is squeezed between these cheeks and the rollers 47. The force required to squeeze the H-section 42 is exerted by way of the rollers 47; the force being exerted can be varied over the surface of the roller. If the force being exerted on the H-section 42 varies over the surface of the roller, it is possible to obtain a lateral curvature proceeding out from the plane of the drawing of FIG. 7. A curvature of the H-section 42 to be bent as shown in FIG. 7 occurs when the forces are exerted uniformly across the surfaces of the rollers 47 onto the H-section 42.

Figure 9:
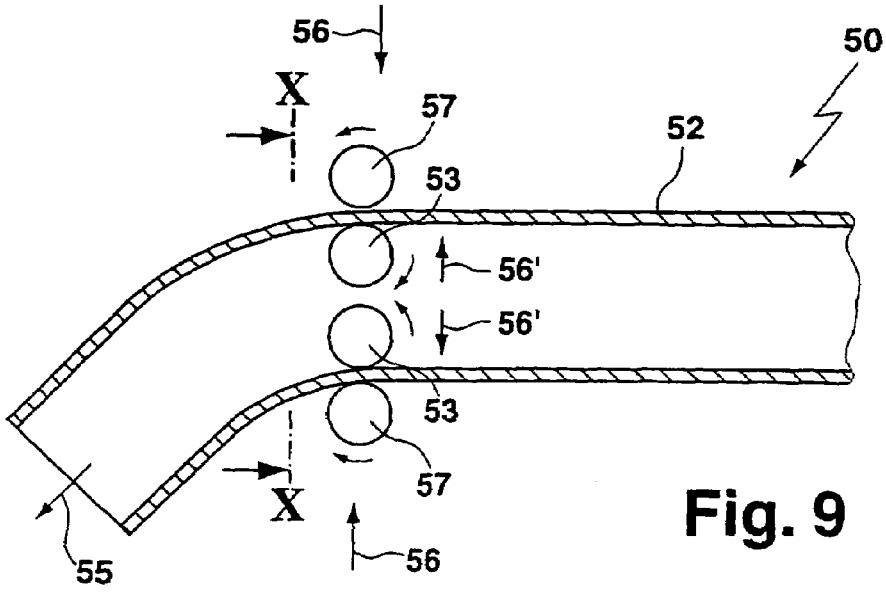
FIG. 9 shows a side view of a bending principle according to the invention with rollers/rolls as pressing and opposing pressing elements.

FIG. 9 shows a side view of another bending principle 50 according to the invention with an H-shaped section 52 to be bent. Rollers/rolls 53 are used as the opposing pressing elements, and the H-section 52 to be bent is transported in the direction of the arrow 55 during the bending operation. The arrows 56 indicate the feed of the pressing elements, which are rollers/rolls 57 here; this feed presses the rolls 57 against the outside surface of the H-section 52 to be bent. During the process of bending the H-section 52, both the rolls 53 and the rolls 57 rotate. The arrows 56' indicate the feed direction of the rolls 53 (opposing pressing elements) toward the inside walls of the H-section 52.

Figure 10:
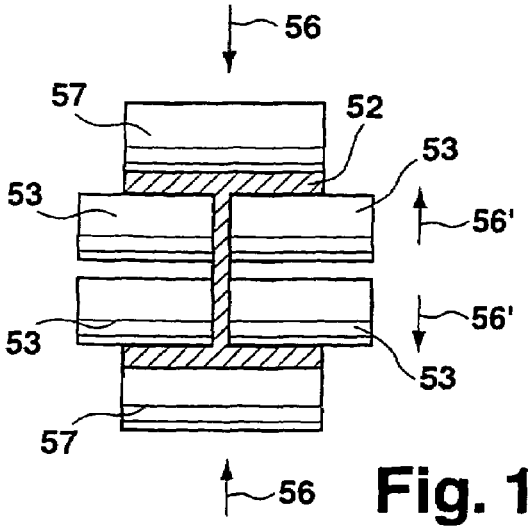
FIG. 10 shows a view along line X—X of FIG. 9.

FIG. 10 shows a view along line X—X of FIG. 9, in which the H-section to be bent is brought out from the plane of the drawing as it passes through the bending process. The rolls 57 press in the direction of the arrows 56 against the outside surfaces of the H-section 52 to be bent, and the rolls 53 form the opposing pressing elements and can also be pressed to varying degrees in the direction of the arrows 56' against the inside walls of the H-section 52 to be bent. The bending principle 50 according to FIGS. 9 and 10 is especially advantageous for processes working with continuous feed because of the reduced wear attributable to the use of rollers for bending. It is obvious that it is not necessary to use four rolls 53 as opposing pressing elements; in the case of simpler H-sections 52 with thinner walls, bending is also possible even when only one roll 57 is used for the bending operation.

Figure 11:
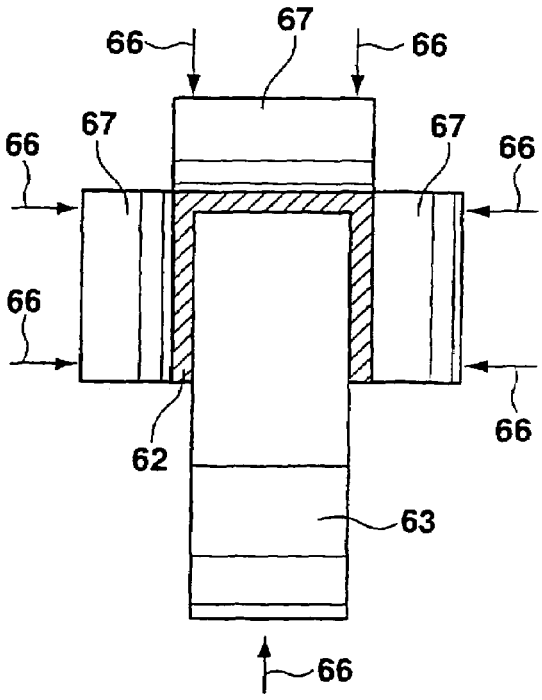
FIG. 11 shows a front view of a bending principle according to the invention with a U-shaped section for bending.

FIG. 11 shows a bending principle 60 according to the invention for a U-shaped section 52 to be bent, in which a roll 63 or an anvil is used as the opposing pressing element. To bend the U-section 62, the U-section 62 to be bent passes over the roll 63 or over the anvil, outward from the plane of the drawing, for example, and by advancing the rolls 67 or rollers in the direction of the arrow 66, the U-section 62 can be bent in the desired manner. The rolls 67 can be subjected to varying pressures across their surfaces, so that a wide variety of bending shapes can be obtained by the use of the bending principle 60 according to the invention.

Figure 12:
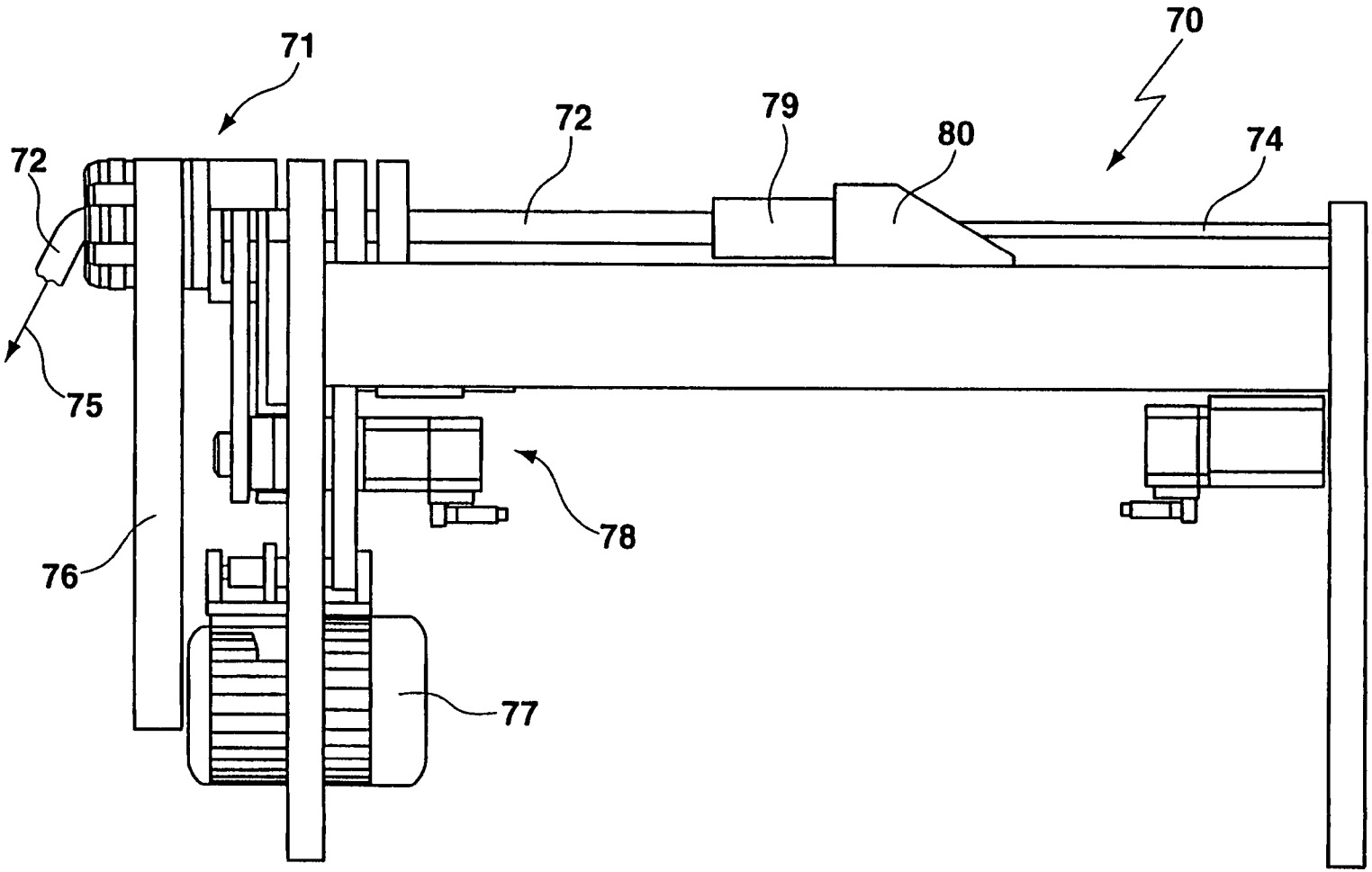
FIG. 12 shows a side view of an embodiment of a bending device according to the invention.

FIG. 12 shows a side view of a bending device 70 according to the invention with a bending tool 71 for bending circular tubes 72. A mandrel has been pushed longitudinally into the circular tube 72; the rod 74 of the mandrel can be fixed in any desired position on the bending device 70. The tube 72 can be pushed through the bending device 71 in the direction of the arrow 75. By means of a drive belt 76, which is connected to a rotating drive motor 77 for the bending tool 71, the bending tool 71 can be rotated around the circular tube 72. An adjusting device for a cam unit of the bending device 70 is indicated at 78; this unit can shift the axis of rotation of the bending tool 71 away from the longitudinal axis of the circular tube 72. In the neutral position of the bending device 70, the axis of rotation of the bending tool 71 coincides with the longitudinal axis of the tube 72 to be bent. When the axis of rotation is shifted away from the longitudinal axis of the tube 72, the pressure which the bending tool 71 exerts on the various cross-sectional areas of the wall of the tube 72 to be bent varies. By way of a clamping chuck 79, the tube 72 to be bent is held in position in the bending device 70, and a tube feed unit 80 pushes the tube 72 to be bent through the bending tool 71. The chuck 79 can also be rotated if desired, so that the tube 72 to be bent can be bent in different directions, depending on how the tube 72 is rotated by the chuck 79.

Figure 13:
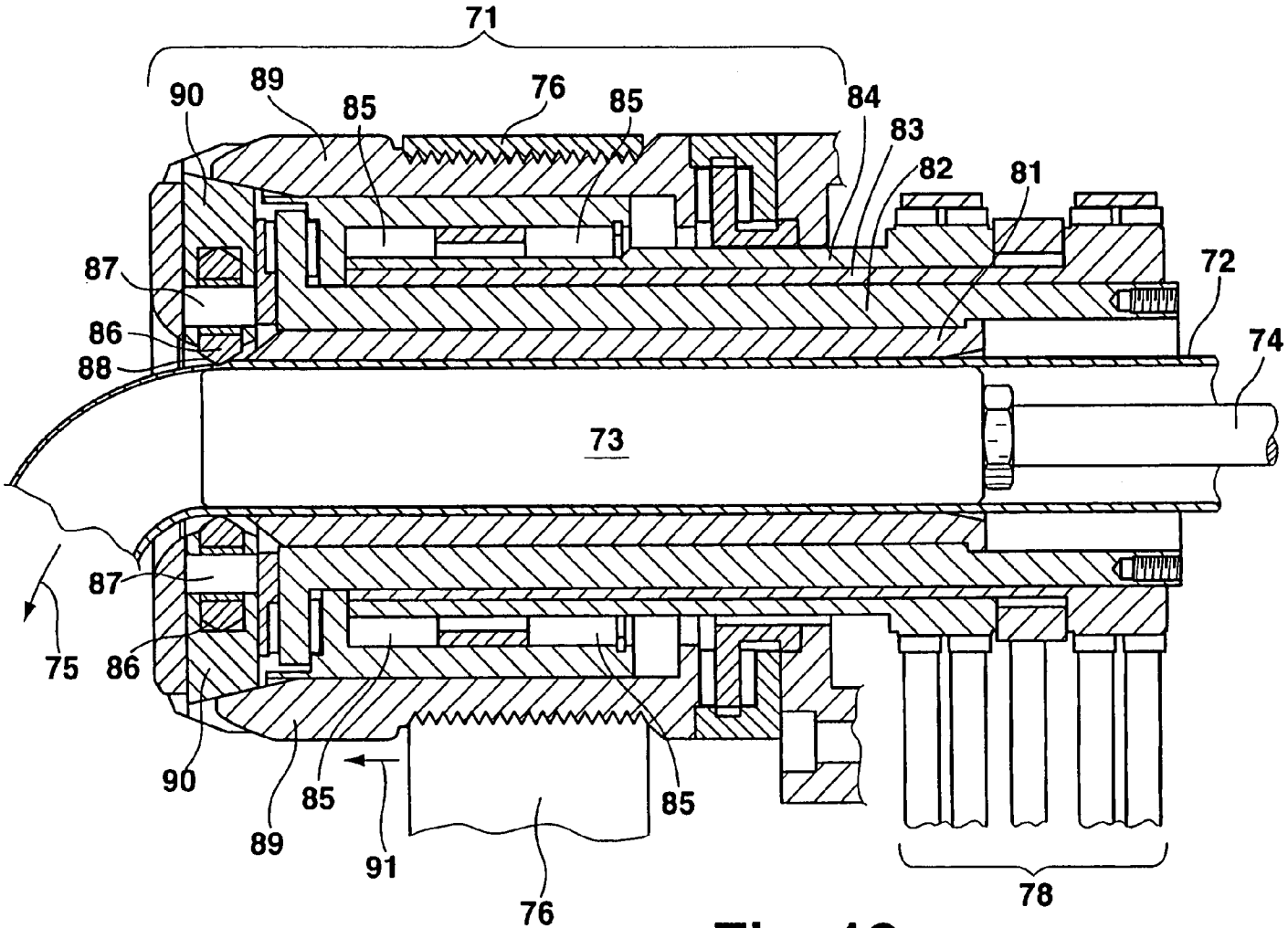
FIG. 13 shows a longitudinal section through a bending tool of the bending device of FIG. 12.

FIG. 13 shows a cross section of a part of the bending device according to the invention with the bending tool 71. The tube 72 to be bent passes through a section guide housing 81, 82, in which the tube 72 to be bent can be moved in a positionally stable manner. In the interior, the tube 72 to be bent is stabilized by a mandrel 73, which is kept in the desired position by the mandrel rod 74 during the bending process. A cam unit is mounted on the stationary section guide housing 81, 82; this cam unit can be rotated with respect to the section guide housing 81, 82. The cam unit is formed by a first and a second tube 83, 84, each of which has different wall thicknesses around their circumferences. The tubes 83, 84 can be rotated to a greater or lesser degree with respect to each other, so that the bending tool 71 supported rotatably on the cam unit can be pushed to a greater or lesser degree away from the longitudinal axis of the tube 72. When the tubes 83, 84 are rotated with respect to each other, the axes of the cam unit and of the circular tube 72 to be bent no longer coincide, and the bending tool 71 rotatably supported on the cam unit rotates eccentrically around the longitudinal axis of the tube 72 to be bent. The support of the bending tool 71 on the second tube 84 of the cam unit is indicated by the reference number 85 in the figure.

The bending tool 71, which, during a bending process, rotates around the cam unit, consisting of the first and the second tube 83, 84, has rollers 86 to serve as pressing elements, which are rotatably supported on axles 87. The rollers 86 press via their surfaces 88 against the outside circumference of the tube 72 to be bent. As the bending tool 71 rotates around the tube 72 to be bent, the rollers 86 thus squeeze different cross-sectional areas of the wall of the tube 72 to be bent to different degrees, so that these varying forces have the effect of bending the tube 72. The tube 72 to be bent is stretched or squeezed to varying degrees in different cross-sectional areas of its wall.

Independently of the cam unit, which is formed by the first and the second tube 83, 84, the rollers 86 can also be pushed by one or more wedge rods 89 toward the tube 72 to be bent. The rollers 86 are supported in a roller housing 90, which is supported so that it can slide up and down in the housing of the bending tool 71. When the wedge rods 89 are pushed in the direction of the arrow 91, the diameter of the orbit of the rollers 86 decreases, and the pressure on the circular tube 72 to be bent increases. The pressure which the rollers 86 exert on the outside circumferential surface of the circular tube 72 to be bent can also be reduced by retracting the wedge rods 89 in the direction opposite that of the arrow 91.

The bending device shown in FIG. 12 makes it possible to adjust the various forces, acting on a circular tube 72, to be bent independently of each other both by shifting the cam unit in the desired manner and also by adjusting the rollers 86 with respect to each other.

Figure 14:
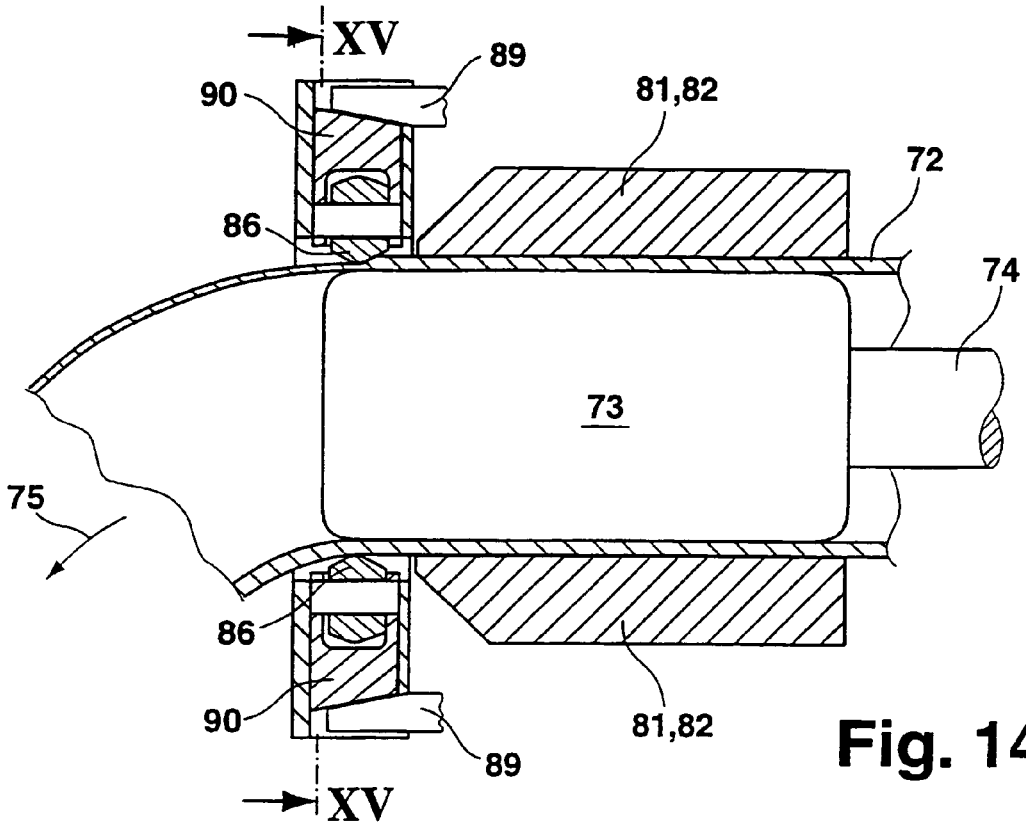
FIG. 14 shows a detailed view of the pressing elements of a bending device according to the invention in longitudinal cross section.

FIG. 14 shows a simplified cross-sectional diagram, which illustrates again how the rollers 86 are adjusted by means of the wedge rods 89, which are components of the bending tool 71. The section guide housing 81, 82 is indicated in the figure; it guides the tube 72 to be bent during its passage through the bending device. The mandrel 73, held in position by the mandrel rod 74, supports the contour of the section and also serves as an abutment for the rollers 86, which form the pressing elements. The rollers 86 are rotatably supported in a roller housing 90, which can move up and down inside the housing of the bending tool 71 by way of the wedge rods 89. The bending tool rotates in the manner shown in FIG. 7 eccentrically around the longitudinal axis of the tube 72 to be bent and thus squeezes the upper area of the tube 72 to be bent more strongly than the lower area. This is indicated by the thinning of the cross section of the wall of the section in FIG. 14. The tube 72 to be bent is pushed through the bending device in the direction of the arrow 75.

Figure 15:
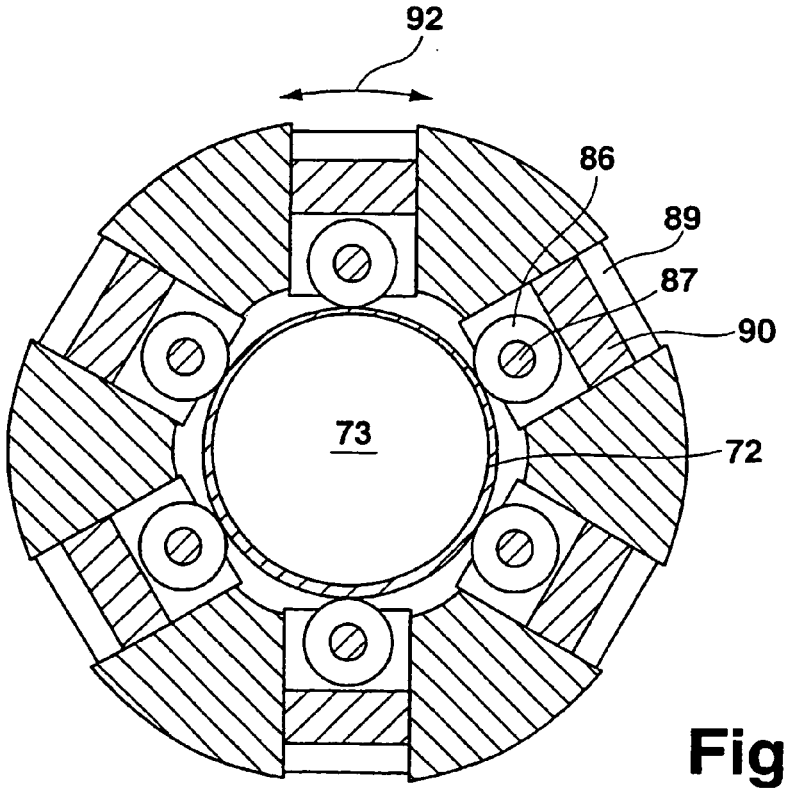
FIG. 15 shows a view along line XV—XV of FIG. 14.

FIG. 15 shows a view along line XV—XV of FIG. 14. The interior of the tube 72 to be bent is filled by the mandrel 73, and rollers 86 exert pressure on the outside circumference of the tube 72. The rollers 86 are rotatably supported on axles 87, which are mounted in the roller housing 90. The roller housing 90 can be shifted via wedge rods 89. The bending tool can rotate in the direction of the arrow 92 around the tube 72 to be bent. The components in FIG. 15 not described in detail are parts of the bending tool 71, which hold together and support the individual pressing elements, here the rollers 86.

Figure 16:
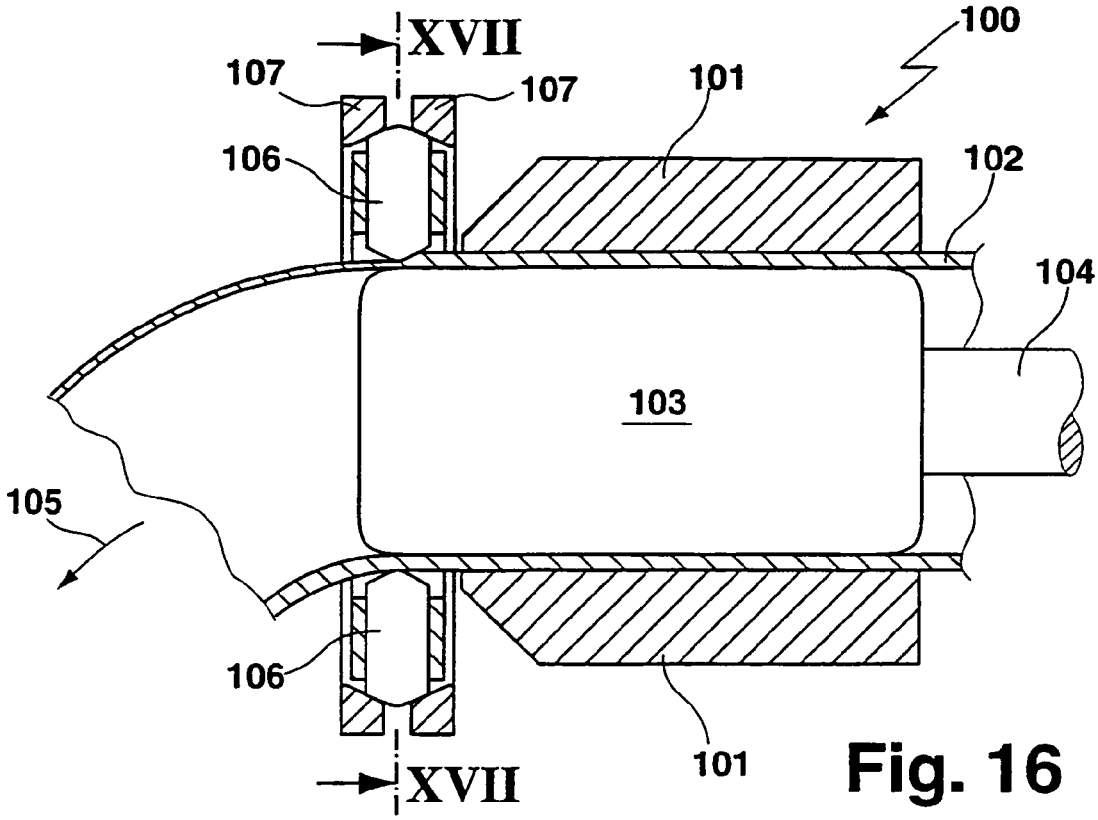
FIG. 16 shows a detailed view of the pressing elements of a bending device according to the invention with conical sleeves.

FIG. 16 shows another embodiment of a bending tool 100, which can be used in a bending device according to the invention. A section guide housing 101 stably guides a tube 102 to be bent through the bending device according to the invention, and a mandrel 103 supports and secures the cross-sectional form of the tube 102 to be bent. The mandrel 103 is held by a mandrel rod 104, and the tube 102 to be bent, by way of the mandrel 103 and by way of the mandrel rod 104, can be pushed through the section guide housing 101 in the direction of the arrow 105. Rollers 106 are provided as pressing elements, and the mandrel 103 serves as the abutment. By moving the conical sleeves 107 toward each other, the distance between the rollers 106 can be adjusted, and by means of this adjustment, the pressure on the outside circumferential surface of a tube 102 to be bent can be increased or decreased. The rollers 106, which are rotatably supported in a cage, are driven via the rotation of the conical sleeves 107 by static friction.

Figure 17:
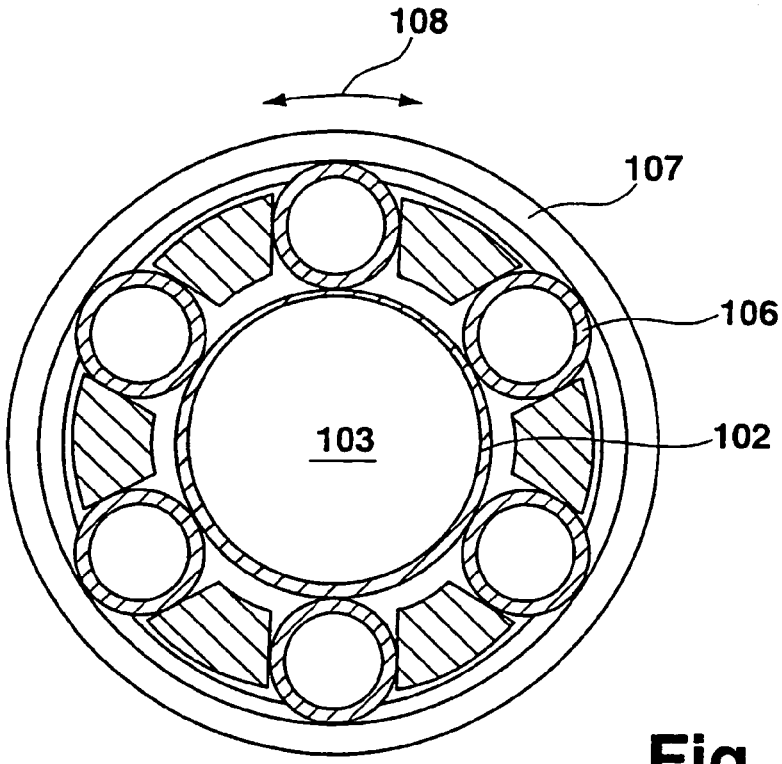
FIG. 17 shows a view along line XVII—XVII of FIG. 16.

FIG. 17 shows a view along line XVII—XVII of FIG. 16. The interior of the tube 102 to be bent is completely filled by the mandrel 103, and the tube 102 to be bent is squeezed against the mandrel 103 by the rollers 106, as the bending tool rotates around the tube 102 to be bent in one of the directions of the arrow 108. The conical rings 107 make it possible to shift the rollers 106 to varying degrees, which are rotatably supported in a cage, toward the outside circumference of the tube 102 to be bent.

Figure 18:
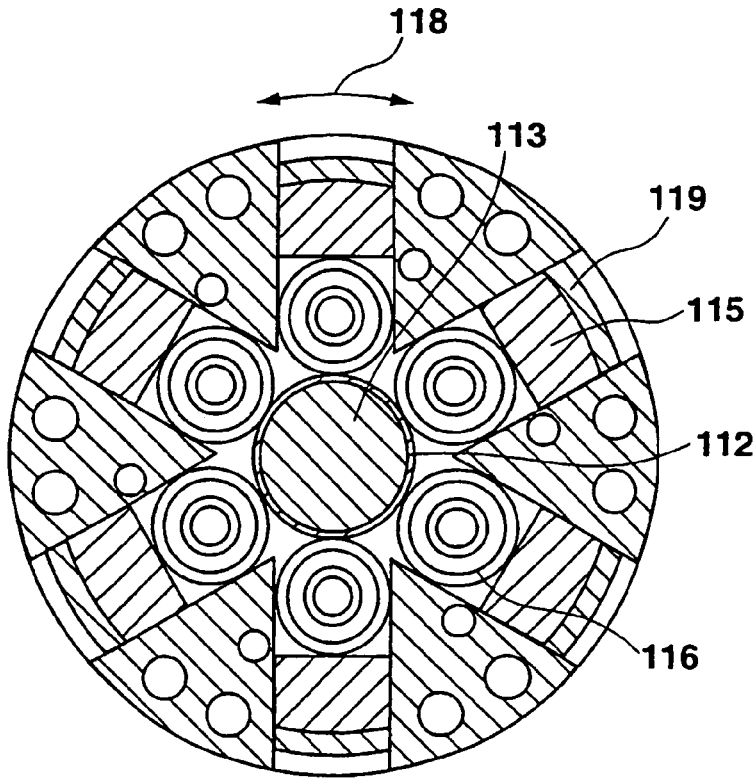
FIG. 18 shows another cross section through a bending tool of a bending device according to the invention in the area of the pressing elements.

FIG. 18 shows a different cross section through a bending tool which can also be used in the bending device according to the invention. A tube 112 to be bent is stabilized by a mandrel 113, which simultaneously forms an abutment for the pressing elements. Rollers 116 are rotatably supported in roller housings 115, and as they rotate in one of the directions of the arrow 118, they squeeze the tube 112 to be bent to varying degrees around the circumference of the tube 112, so that, after a bending operation, the tube 112 to be bent has wall cross sections of different thicknesses in the bent area. By way of wedge rods 119, the roller housings 115 can be shifted up and down inside the housing of the bending tool.

It is obvious that the axial feeds shown in FIGS. 13–17 with respect to the tube to be bent can also be influenced by a cam unit, which can cause the bending tool rotating around the tube to be bent, to rotate eccentrically around the longitudinal axis of the tube to bent.

FIG. 19*a* shows in highly schematic form the design of a cam unit 125, which can be used in a bending device of the type according to the invention. The cam unit 125 is formed by two tubes 126, 127, which are eccentric in cross section. The two tubes can rotate relative to each other and can be locked in any desired rotational position. In FIG. 19*a*, the two tubes 126, 127 are shown in a null position; that is, the total wall thickness, seen in cross section, is constant around the entire circumference of the cam unit 125. This means that a bending device rotating around a circular orbit 129 rotates in a null position with an axis of rotation that coincides with the longitudinal axis of the tube to be bent.

FIG. 19*b* shows an extreme position of the cam unit 125. The tubes 126, 127 have been turned to the maximum degree with respect to each other, based on their individual eccentricities. This means that, when a bending tool rotates around the circular orbit 129 around the cam unit 125, the bending tool will be pressed against the outside circumferential surface of the tube to be bent to the maximum amount at the uppermost point of the circular orbit, whereas the pressing elements will be at the maximum distance away from the outside circumferential surface of the tube to be bent (weakest contact pressure) at the low point of the orbit 129.

In a device and in a component for bending a tube 72, the tube 72 is guided through a bending tool 71, which rotates around a section guide housing 81, 82 and around a cam unit, formed by two tubes 83, 84. Rollers 86 serve as pressing elements, and a mandrel 73 serves as an abutment. As the tube 72 is pushed through the section guide housing 81, 82, it is squeezed between the rollers 86 and the mandrel 73 to varying degrees in different cross-sectional areas of its walls, so that a bend is produced by the stretching and squeezing of the tube 72. The size of the bending radius of a tube 72 to be bent is determined by the eccentricity set by way of the cam unit and/or the axial feed of the rollers 86 toward the section guide housing 81, 82. By means of the bending tool 71 according to the invention, different bending radii can be produced in one and the same bending device on a tube 72 to be bent by changing the feed, that is, the distance between the rollers 86 and the mandrel 73. No uncontrolled cracks or deformations occur. The bending tool 71 used imposes only minimal limitations on how a tube 72, can be bent in any of 3 dimensions, which means that a section for bending can be bent into any desired shape.

The invention claimed is:

1. Device for bending sections with walls which have cross-sectional areas at different distances from the axis of the bend to be produced, the device comprising a bending tool with at least one pressing element and at least one opposing pressing element assigned to one of the pressing elements, and where at least one pressing element and at least one of the opposing pressing elements assigned to it can be moved relative to each other to squeeze at least one cross-sectional area of the section wall situated on the outside with respect to the axis of the bend, the at least one pressing element and the at least one of the opposing pressing elements being movable in the cross-sectional direction of the at least one squeezed cross-sectional area of the section wall, wherein the pressing element or elements (27; 37; 86; 106; 116) are advanced toward the opposing pressing element or elements (23; 33; 73; 103; 113) in the cross-sectional direction while maintaining a gap between them, the width of the gap in at least one cross-sectional area being smaller than a cross-sectional area of the wall of the section to be bent which is being transported through the gap, wherein the pressing element or elements are designed as rollers, and/or as rolls (27; 37; 47; 57; 67; 86; 106; 116) which rest against an outer side of the section wall, wherein the opposing pressing element or elements are designed as mandrels (13; 23; 33; 73; 103; 113) which rest against interior areas of the cross section of the section wall, wherein the device for bending has a stationary section guide housing (81, 82) and a cam unit (83, 84), which rotatably surrounds the section guide housing (81, 82), on which cam unit the roller, the roll, or the several rollers or rolls (86), which are rotatably supported independently of the cam unit (83, 84), are mounted.

2. Device according to claim 1, wherein the size and/or cross-sectional shape of the gap can be varied.

3. Device according to claim 1, wherein the section is pushed and/or pulled through the gap.

4. Device according to claim 1, wherein the roller, the roll, or the several rollers or rolls (27; 37; 86; 106; 116) are supported rotatably and extend parallel to the axial orientation of the section or have an axis of rotation that is transverse to the axial orientation of the section.

5. Device according to claim 4, wherein the roller, the roll, or the several rollers or rolls (27; 37; 86; 106; 116) and/or the mandrel (23; 33; 73; 103; 113) can be subjected to variable pressures across their dimension transverse to the axial orientation of the section.

6. Device according to claim 1, wherein, during a bending operation, the section (72) is held stationary, is shifted in the axial direction, and/or is rotated around an axis of the section (72) by holding means such as a chuck (79).

7. Device according to claim 1, wherein the orientation of the roller, the roll, or the several rollers or rolls (86) with respect to the section guide housing (81, 82) is adjustable independently of the cam unit (83, 84).

8. Device according to claim 1, wherein the cam unit is formed by a first and a second tube (83, 84), where, seen in cross section, one of the tubes (83, 84) surrounds the other, the two tubes being rotatable relative to each other, and where the wall thickness of the tubes (83, 84) varies around their circumference.

9. Device according to claim 8, wherein the circular tubes (83, 84) can be locked in any rotational position.

10. Device according to claim 5, wherein the orientation of the roller, the roll, or the several rollers or rolls (86; 106) with respect to the section guide housing (81; 82; 101) can be adjusted by one or more wedge rods (89) or by one or more conical sleeves (107).

11. Device according to claim 1, wherein the roller, the roll, or the several rollers or rolls (27; 37; 86; 106; 116) are mounted so that they can rotate around the section to be bent (22; 32; 72; 102; 112).

12. Device according to claim 1, wherein the cam unit (83, 84) can be adjusted hydraulically, pneumatically, or by means of a mechanical gear assembly.

* * * * *